US008002149B2

(12) United States Patent
Leonard

(10) Patent No.: US 8,002,149 B2
(45) Date of Patent: Aug. 23, 2011

(54) CHILD RESISTANT CLOSURE

(75) Inventor: Gary Leonard, Celbridge (IE)

(73) Assignee: Loctite (R&D) Limited, Dublin (IE)

( * ) Notice: Subject to any disclaimer, the term of this patent is extended or adjusted under 35 U.S.C. 154(b) by 501 days.

(21) Appl. No.: 11/836,834

(22) Filed: Aug. 10, 2007

(65) Prior Publication Data

US 2008/0035597 A1 Feb. 14, 2008

(51) Int. Cl.
*B65D 50/04* (2006.01)

(52) U.S. Cl. ..... 222/153.1; 222/153.14; 215/211

(58) Field of Classification Search ..... 222/153.14, 222/153.09, 153.1; 215/211
See application file for complete search history.

(56) References Cited

U.S. PATENT DOCUMENTS

| | | | | |
|---|---|---|---|---|
| 3,880,314 | A * | 4/1975 | Akers | 215/214 |
| 3,927,783 | A * | 12/1975 | Bogert | 215/222 |
| 4,567,992 | A * | 2/1986 | Davis | 215/222 |
| 5,148,931 | A * | 9/1992 | Minh | 215/220 |
| 5,228,583 | A * | 7/1993 | Weinstein | 215/220 |
| 5,462,181 | A * | 10/1995 | Glynn | 215/204 |
| 6,082,565 | A * | 7/2000 | Harrold | 215/218 |
| 6,202,876 | B1 * | 3/2001 | DeJonge | 220/217 |
| 6,378,713 | B2 * | 4/2002 | Montgomery | 215/222 |
| 2007/0210027 | A1 | 9/2007 | Abbott | |

FOREIGN PATENT DOCUMENTS

GB 2 322 621 A 9/1998

OTHER PUBLICATIONS

International Search Report dated May 19, 2008 issued by the Irish Patent Office For Irish Patent No. 2006/0591.

* cited by examiner

*Primary Examiner* — Kevin P Shaver
*Assistant Examiner* — Donnell Long
(74) *Attorney, Agent, or Firm* — James E. Piotrowski

(57) ABSTRACT

The present invention provides a child-resistant closure for a container. The closure comprises a dispensing nozzle, a cap for the dispensing nozzle, inter-engaging formations and a resiliently deformable element. The inter-engaging formations provided on the closure hold the cap to the nozzle in an interengaged assembly thereof. The resiliently deformable element biases the cap and the nozzle apart. The inter-engaging formations comprise a retaining slot for receiving a retainer and a retainer for engagement with the retaining slot. The retaining slot, retainer and resiliently deformable element are arranged so that the cap and the nozzle are retained interengaged in the interengaged assembly by bias from the resiliently deformable element. The release of the interengaging formations is achieved by applying sufficient pressure axially to the assembly to overcome the bias of the resiliently deformable element, and sufficient turning force to move the retainer out through the opening of the retaining slot.

4 Claims, 2 Drawing Sheets

CHILD RESISTANT CLOSURE

FIELD OF THE INVENTION

The present invention relates to child resistant closures. More particularly, the invention relates to a child resistant closure suitable for use with a container having a dispensing nozzle.

BACKGROUND TO THE INVENTION

Child resistant closures are well known. One commonly used child resistant closure comprises a cap which is removable from the container to which it is attached by applying inward pressure to opposing sides of the cap while simultaneously rotating it. To close the cap, the reverse technique is applied.

However this closure is not suitable for use with a container requiring a dispensing nozzle.

Bayonet fittings are a well known closure mechanism. In this type of closure, two separate components are secured together by means of a particular lug and groove arrangement, with the lug provided on one of the components and the groove provided on the other component. To interengage the two components, the lug is first received into the groove, and then secured into position by twisting one component relative to the other until the lug is moved into position in the blind end of the groove. To separate the two components from each other, the reverse action is applied. A twisting action suffices to separate the two parts.

OBJECT OF THE INVENTION

The present invention provides an alternative child resistant closure suitable for use with a dispensing nozzle.

SUMMARY OF THE INVENTION

The present invention provides a child-resistant closure for a container comprising:

(i) a dispensing nozzle comprising a nozzle body with a first end and a second dispensing end and with a conduit defined therein for delivering product from the first end to the dispensing end;

(ii) a cap for the dispensing nozzle the cap having a closed end and a skirt depending therefrom to define a nozzle-receiving housing;

(iii) inter-engaging formations provided on the closure for holding the cap to the nozzle in an interengaged assembly thereof with the cap over the nozzle body and the nozzle received in the housing; and (iv) a resiliently deformable element on the closure for biasing the cap and the nozzle apart, the inter-engaging formations comprising:

(a) a retaining slot for receiving a retainer; and (b) a retainer for engagement with the retaining slot, the retaining slot being formed with a first slot portion with an opening, a second return slot portion radially displaced with respect to the first slot portion and with a blind end, and a connecting slot portion for connecting the first slot portion to the second slot portion, the retaining slot, retainer and, resiliently deformable element being arranged so that the cap and the nozzle are retained interengaged in the interengaged assembly by bias from the resiliently deformable element which biases the retainer into the blind end of the retaining slot and wherein release of the interengaging formations is achieved by applying sufficient pressure axially to the assembly to overcome the bias of the resiliently deformable element, and sufficient turning force to move the retainer from the blind end through the connecting portion and into the first slot portion, whereby the interengaging formations can be released by movement of the retainer out through the opening.

The use of a resiliently deformable element which biases the retainer into the blind end of the retaining slot provides a simple and cost effective means of preventing a child from removing the cap from the nozzle.

In one embodiment of the invention, the retaining slot is formed on the nozzle and the retainer is formed on the cap.

In an alternative embodiment of the invention, the retaining slot is formed on the cap and the retainer is formed on the nozzle.

Preferably, opposing slots and corresponding opposing retainers are provided on opposing sides of the closure.

In one embodiment of the invention, the resiliently deformable element is part of the nozzle which is arranged to bias the cap and the nozzle apart.

In an alternative embodiment, the resiliently deformable element is part of the cap which is arranged to bias the cap and the nozzle apart.

Suitably, the resiliently deformable element is internally located within the cap.

The deformable element may comprise two parts, one on the cap and one on the nozzle, acting together to bias the cap and the nozzle apart.

The resiliently deformable element may comprise a deformable ring or ring segment.

Alternatively, the resiliently deformable element may comprise a deformable shoulder or shoulder portion.

In yet another alternative, the resiliently deformable element may comprise both a deformable ring or ring segment and a deformable shoulder or shoulder portion.

The ring or ring segment may comprise an annular wall or annular wall segment located within and arranged on the cap.

Preferably, the annular wall or annular wall segment is arranged to abut the nozzle and resiliently deform to provide the bias for biasing the cap and the nozzle apart.

BRIEF DESCRIPTION OF THE DRAWINGS

The invention will now be described with reference to the accompanying drawings, in which:

FIG. 5 is a view from the top of the nozzle of FIG. 1;

DETAILED DESCRIPTION OF THE DRAWINGS

Figure 1:
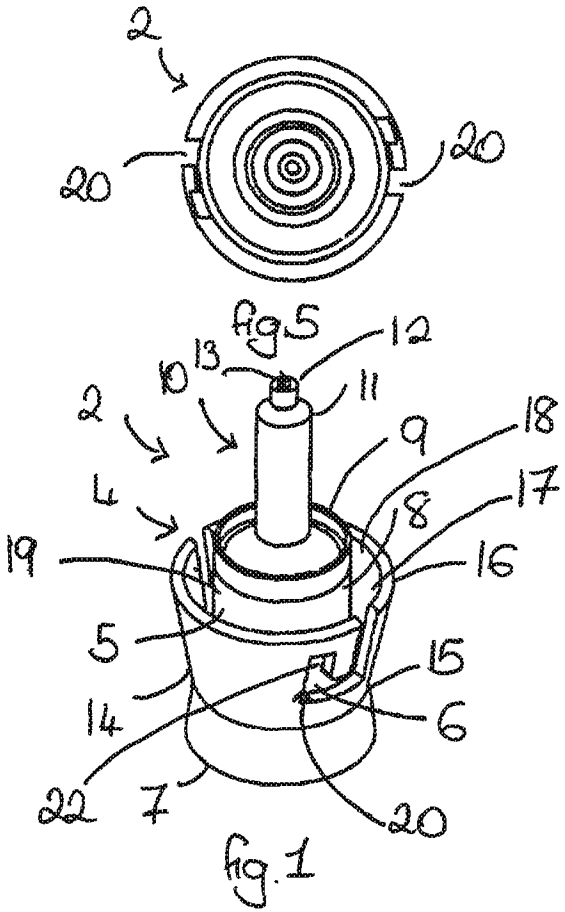
FIG. 1 is a perspective view of the nozzle of the child resistant closure of the present invention.
Figure 3:
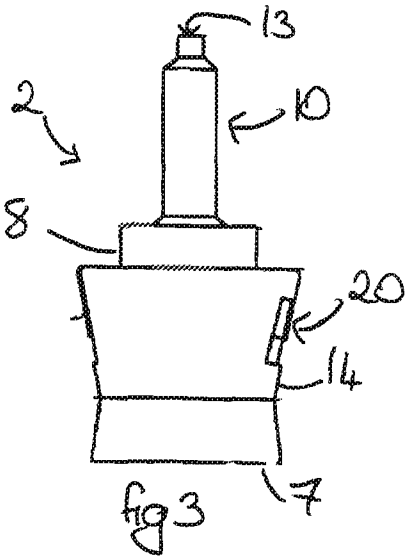
FIG. 3 is a front view of the nozzle of FIG. 1.
Figure 4:
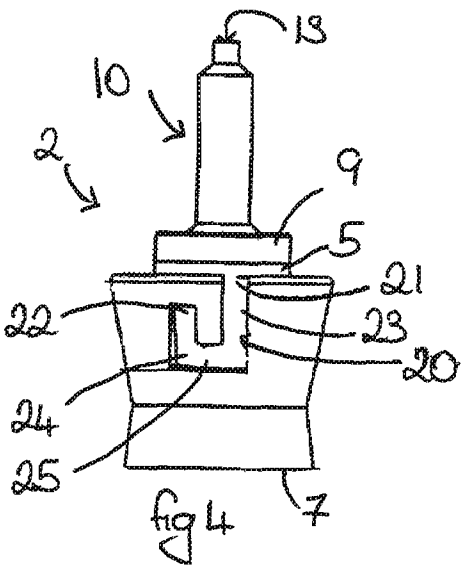
FIG. 4 is an alternative front view of the nozzle showing the retaining slot.
Figure 6:
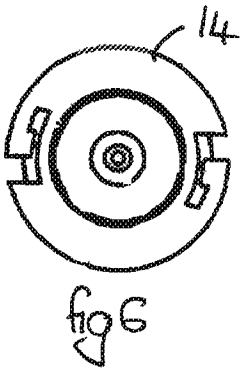
FIG. 6 is a view from the bottom of the nozzle of FIG. 1.
Figure 2:
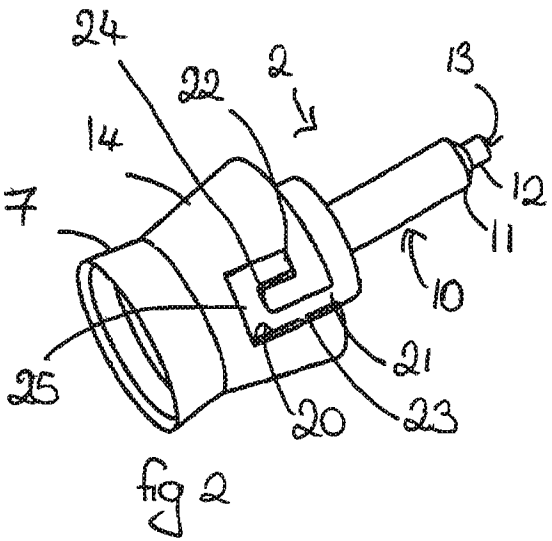
FIG. 2 is an alternative perspective view of the nozzle taken from the side.
Figure 8:
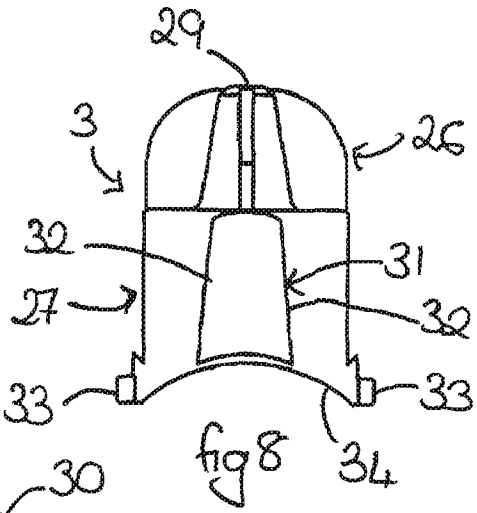
FIG. 8 is a front view of the cap of FIG. 7.
Figure 7:
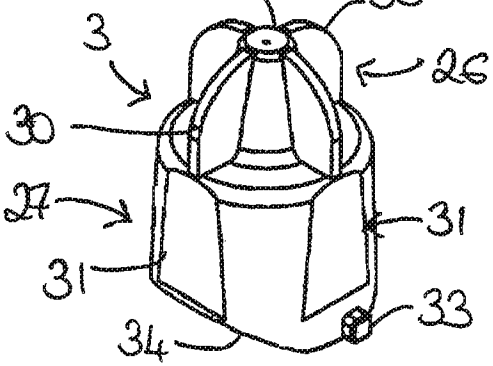
FIG. 7 is a perspective view of the cap of the child resistant closure of the present invention.
Figure 11:
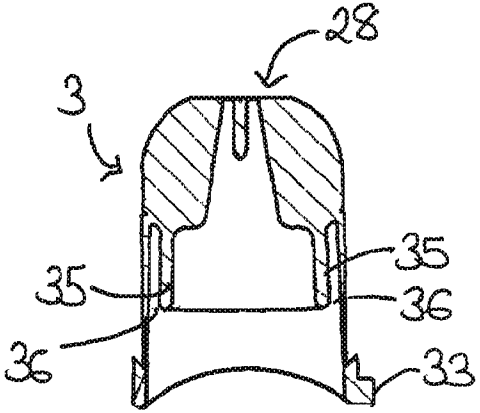
FIG. 11 is a view along the section A-A of FIG. 10.
Figure 10:
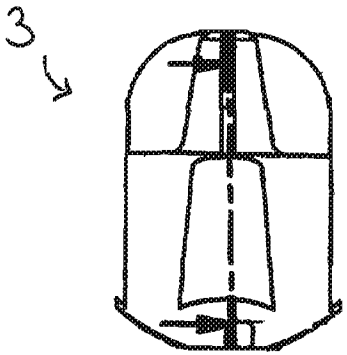
FIG. 10 is a front view of the cap of FIG. 7 detailing the section A-A.
Figure 9:
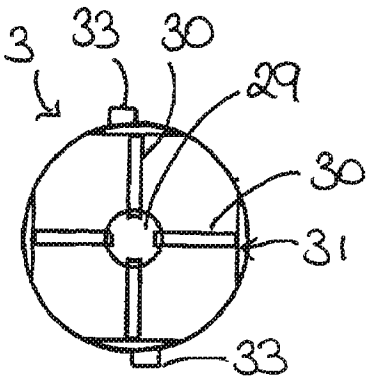
FIG. 9 is a plan view of the cap of FIG. 7.

The present invention will now be described with reference to the accompanying FIGS. 1 to 11.

The child-resistant closure 1 of the present invention comprises a dispensing nozzle 2 interengagable with a cap 3 in such a manner so as to generally prevent a child from being able to separate the cap 3 from the nozzle 2 when interengaged.

FIGS. 1 to 6 illustrate the nozzle 2 of the child resistant closure 1. It comprises a nozzle body 4 having a hollow cylindrical main portion 5. The lower end 6 of the main portion 5 is connected to a first end 7 of the nozzle body 4 which is adapted for attachment to a container with which the closure may be used. This first end 7 takes the form of a collar which tapers outwards from the lower end 6 of the main portion 5. The upper end 8 of the main portion 5 terminates in a raised rim 9. The nozzle body 4 also has a second dispensing end 10 which extends upwards from the centre of the upper end 8 of the main portion 5. The dispensing end 10 is also cylindrical in shape, but has a smaller cross section than that of the main portion 5. The top 11 of the dispensing end 10 is provided with a tip 12, through which product can be dispensed. A conduit 13 is located within the nozzle 2 for delivering product from the first end 7 to the tip 12.

The nozzle 2 is also provided with a skirt or ring 14 which is positioned about the centre point of the main portion 5 of the nozzle body 4. One end 15 of the ring 14 is attached to the collar 7, while the other end 16 is open. The ring 14 is dimensioned such that a spacing 17 exists between the inner wall 18 of the ring 14 and the outer wall 19 of the main portion 5 of the nozzle 2 which can accommodate a cap 3 when the cap 3 and nozzle 2 are being arranged to interengage.

A pair of retaining slots 20 are provided on the skirt 14 on opposing sides 180 degrees apart from each other. The retaining slots 20 are adapted to secure the cap 3 to the nozzle 2. The retaining slots 20 are substantially U-shaped, with one end of the U shape having an opening 21 and the other end taking the form of a blind end 22. The opening 21 leads to the first leg of the U shape, which forms a first slot portion 23. The second leg of the U shape forms a second return slot portion 24 having the blind end 22. The second return slot portion 24 is therefore radially displaced with respect to the first slot portion 23. The base of the U shape is formed by a connecting slot portion 25, which connects the first slot portion 23 to the second slot portion 24. This structure of the retaining slot 20 enables a retainer located on the cap 3 to be received within the opening 21, and moved into position at the blind end 22 of the slot, so as to provide a secure interengagement between the cap 3 and the nozzle 2, as will be described in more detail below.

FIGS. 7 to 11 illustrate the cap 3 of the child resistant closure 1. The cap 3 comprises a closed end 26 connected to a skirt 27, which together are dimensioned to provide a nozzle-receiving housing 28. The closed end 26 comprises a central protrusion 29 surrounded by a plurality of grips 30. The grips 30 are arcuate in shape and are positioned radially about the central protrusion 29 in a spaced apart arrangement, in order to facilitate the insertion and removal of the cap 3 from the nozzle 2.

The skirt 27 incorporates a plurality of substantially rectangular indentations 31 at spaced apart intervals about its exterior surface. The side walls 32 of the indentations 31 extend to the height of the skirt 27 and taper inwards in the direction towards the closed end 26 of the cap 3. These indentations serve as a further aid for gripping the cap 3. A pair of retainers 33 are provided on opposing sides of the skirt 27 spaced 180 degrees apart from each other for engagement with the corresponding retaining slots 20 provided on the nozzle 2. The retainers 33 are dimensioned so as to fit within the opening 21 of the retaining slots 20. In the described embodiment, the retainers take the form of rectangular protrusions or pips 33. The pips 33 are located just above the bottom surface 34 of the skirt 27 and directly below two of the grips 30. The skirt 27 is dimensioned to fit in the spacing provided between the inner wall 18 of the ring 14 and the outer wall 19 of the main portion 5 of the nozzle 2.

A resiliently deformable element 35 is located on the inner surface 36 of the skirt of the cap 3. This provides the means for biasing the cap 3 and the nozzle 2 apart. In the preferred embodiment of the invention, the resiliently deformable element 35 is a deformable abutment portion, which in the embodiment is of annular shape, and depends downwardly inside the cap 3. The annular shape taken by the element is arranged to abut against the outer wall 19 of the main portion 5 of the nozzle 2 and resiliently deform when the cap 3 is placed over the nozzle body 4.

The retaining slots 20 together with the pips 33 comprise the interengaging formations of the closure 1, for holding the cap 3 to the nozzle 2 in an interengaged assembly, with the cap 3 over the nozzle body 4 and the nozzle 2 received in the housing.

The closure 1 of the present invention is adapted for use with a container. The closure 1 may be connected to a container by attachment of the first end 7 of the nozzle 2 to the top of the container by any suitable means such as screwthreading, snap fitting or the like. The tip 12 may then be used to dispense product held within the container when the cap 3 is disengaged from the nozzle 2, as product will be taken up into the conduit and dispensed through the dispensing tip.

To close the closure, the cap 3 must be interengaged with the nozzle 2. This is achieved by first aligning the pips 33 located on the cap 3 with the corresponding openings 21 of the retaining slots 20 located on the nozzle body 4. The cap 3 is then subjected to axial pressure, so that the pips 33 may be received by the corresponding openings 21 of the first slot portion 23. At the same time, a clockwise turning force is applied to the cap 3 in order to displace the pips 33 along the corresponding connecting slot portion 25 of the retaining slots 20 until they reach the second return slot portion 24. Once located in the second return slot portion 24, the cap 3 is maintained interengaged in the spacing 17 between the inner wall 18 of the rig 14 and the outer wall 19 of the main portion 5 of the nozzle 2 by the action of the resiliently deformable element 35 of the cap 3. This resiliently deformable element 35 flexes against the outer wall 19 of the main portion 5 of the nozzle 2 such that it biases the cap 3 apart from the nozzle 2. As the cap 3 is now interengaged with the nozzle 2 by means of the pips 33 being located in the retaining slots 20, the bias causes the pips 33 to be pushed upwards and biased against the blind end 22 of the retaining slots 20. The cap 3 and nozzle 2 now form a secure interengaged assembly and the cap 3 can not rotate. In this position, the closure is such that a child will not usually be able to separate the cap 3 from the nozzle 2 because they should not be able to release the cap 3.

Release of the interengaged assembly is the reverse of the engagement process. To release, sufficient pressure should be applied axially to the cap 3 to overcome the bias of the resiliently deformable element 35 of the cap 3 biasing the cap 3 apart from the nozzle 2, while simultaneously applying sufficient turning force in an anti-clockwise direction to move the pips 33 of the cap 3 from the blind end 22 of the corresponding retaining slot 20, through the connecting slot portion 25 and into the first slot portion 23. At this point, the pips 33 can be released from the first slot portion 23 by movement of the pips 33 out through the opening 21.

It will be appreciated that the closure of the present invention is not intended to be limited to the described embodiment. For example, a resiliently deformable annular segment could be used in place of a complete annular portion, provided that the resilience of such a segment is adapted to impart sufficient biasing apart of the nozzle and the cap in order to maintain the pips biased against the blind end of the retainer. Similarly, the resiliently deformable element could instead take the form of a shoulder or shoulder portion located at the lower end of the skirt of the cap.

In yet another envisaged embodiment, the resiliently deformable element could be located on the nozzle rather than the cap. For example, the spacing between the inner wall of the ring and the outer wall of the main portion of the nozzle could be provided with an abutment portion, adapted to bias the cap apart from the nozzle when the nozzle is positioned within the nozzle-receiving housing of the cap. Alternatively, the deformable element could comprise two parts, one on the cap and one on the nozzle. These two parts could then act together to bias the cap and the nozzle apart. The two parts could comprise one or both of a deformable ring/ring segment and a deformable shoulder/shoulder portion.

In another alternative embodiment, the retaining slot could be provided on the cap and the retainer on the nozzle. It will be appreciated that the steps required to interengage and disengage the cap with the nozzle in such an arrangement would be substantially the same as those required by the present embodiment.

The present invention provides a number of advantages over the prior art child-resistant closures. Firstly, it enables child-resistant closures to be used with a dispensing nozzle arrangement. It also provides a child resistant closure arrangement which is easy to use. Furthermore, the simplicity of the design results in a cost effective design.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A child-resistant closure for a container comprising:

(i) a dispensing nozzle comprising a nozzle body with a first end and a second dispensing end and with a conduit defined therein for delivering product from the first end to the dispensing end, said body having an outer wall; said nozzle includes an annular ring supported from and positioned about said nozzle body, said annular ring having an inner wall spaced from said body outer wall and defining a space between the body outer wall and annular ring inner wall and open toward the nozzle body second end, said ring including a retaining slot formed therein; and (ii) a cap attachable to the dispensing nozzle, the cap having a closed end and an annular skirt depending therefrom to an open end, an inner wall of the skirt defining a nozzle-receiving housing, said cap including an annular resiliently deformable element extending from said closed end toward said open end and spaced inwardly from the skirt inner wall and defining a space between the inner wall and the annular element open toward the cap open end, said annular element insertable into said nozzle body space wherein said deformable element is resiliently biased against said outer wall of said nozzle body; said cap further including a retainer extending outwardly from said skirt for insertion into a receiving slot of said ring;

wherein said resiliently deformable element biases said cap and said nozzle apart; and wherein the retaining slot is formed with a first slot portion with an opening, a second return slot portion radially displaced with respect to the first slot portion and with a blind end, and a connecting slot portion for connecting the first slot portion to the second slot portion, the retaining slot, retainer and resiliently deformable element being arranged so that the cap and the nozzle are retained interengaged by the bias from the resiliently deformable element which biases the retainer into the blind end of the retaining slot and wherein release of said interengagement is achieved by applying sufficient pressure axially to the assembly to overcome the bias of the resiliently deformable element, and sufficient turning force to move the retainer from the blind end through the connecting portion and into the first slot portion, whereby the cap can be released by movement of the retainer out through the opening.

2. A child resistant closure of claim 1 wherein said cap includes a pair of diametrically opposed said retainers and wherein said nozzle ring includes a pair of diametrically opposed said retaining slots.

3. A child resistant closure of claim 1 wherein said nozzle includes a deformable shoulder for resilient engagement with said resiliently deformable element of said cap.

4. A child resistant closure of claim 1 wherein said annular member includes annular segments.

* * * * *